United States Patent [19]

Velo Dalbrenta

[11] 4,045,929

[45] Sept. 6, 1977

[54] LIQUIDTIGHT TANK MADE OF PRESTRESSED REINFORCED CONCRETE, PARTICULARLY FOR PURIFICATION PLANTS

[76] Inventor: Gianfranco Velo Dalbrenta, Via Velo n. 14, Fontaniva, Italy

[21] Appl. No.: 636,478

[22] Filed: Dec. 1, 1975

[51] Int. Cl.[2] ..... E04H 12/16

[52] U.S. Cl. ..... 52/224; 52/228; 52/245

[58] Field of Search ..... 52/224, 228, 229, 227, 52/192, 194, 248, 438, 437, 435, 245

[56] References Cited

U.S. PATENT DOCUMENTS

| | | | |
|---|---|---|---|
| 217,984 | 7/1879 | Brock | 52/227 |
| 1,425,119 | 8/1922 | Lynde | 52/438 |
| 1,613,587 | 1/1927 | Geraerdts | 52/438 |
| 2,874,812 | 2/1959 | Clevett | 52/227 |
| 3,180,057 | 4/1965 | Pritzker | 52/224 |
| 3,680,275 | 8/1972 | Romlet | 52/227 |

FOREIGN PATENT DOCUMENTS

| | | | |
|---|---|---|---|
| 73,255 | 3/1917 | Austria | 52/438 |
| 1,157,975 | 6/1958 | France | 52/227 |
| 1,458,056 | 10/1966 | France | 52/227 |
| 2,146,433 | 3/1973 | Germany | 52/227 |
| 48,871 | 9/1966 | Germany | 52/224 |
| 697,195 | 9/1953 | United Kingdom | 52/227 |

*Primary Examiner*—Ernest R. Purser
*Assistant Examiner*—Henry Raduazo
*Attorney, Agent, or Firm*—Ladas, Parry, Von Gehr, Goldsmith & Deschamps

[57] ABSTRACT

A liquidtight tank or reservoir, made of generally prestressed reinforced concrete, particularly for purification plants, comprising a plurality of plane plates which are connectable to each other and comprise substantially a central portion and a hammer-shaped element disposed at each of the two ends is described. Between two said hammer-shaped elements belonging to two consecutive plane plates which are approached to each other at the moment of the assembly there is interposed a connection element so that said two consecutive plane plates are connected to each other forming an angle which depends on the dimensions and shape of said connection element.

4 Claims, 9 Drawing Figures

LIQUIDTIGHT TANK MADE OF PRESTRESSED REINFORCED CONCRETE, PARTICULARLY FOR PURIFICATION PLANTS

BACKGROUND OF THE INVENTION

The present invention relates to a liquidtight tank or reservoir made of prestressed reinforced concrete, particularly for purification plants.

The tank or reservoir according to the invention is particularly convenient also for the storage of incoherent materials, for instance cereals in general.

The known technique of construction of tanks or reservoirs both of normal reinforced concrete and prestressed reinforced concrete is so wide that it is not deemed suitable to discuss it herein; it is sufficient to mention some of the constructional and manufacturing methods which are used presently, pointing out some disadvantages deriving therefrom, the prevention of such disadvantages being, among other things, the object of the present invention.

According to a first technique of construction, the tanks or reservoirs are pre-fabricated as an integral body up to dimensions which are compatible with the transport problem. Over certain dimensions, owing to a practical impossibility of transport, they are constructed directly on the spot according to well known methods of construction.

A common feature of these techniques of construction is their hand-made character, which nowadays constitutes a significant disadvantage, mainly because of the high costs of labor deriving therefrom.

Moreover, the prestress of the concrete is, from the technical point of view, a complex operation, so that if tanks or reservoirs are to be constructed of normal reinforced concrete, a considerable quantity of material is required which represents a further cost in addition to the cost of the labor which is high in itself.

Other techniques of construction exist which allow the manufacture of the tanks or reservoirs by assembling on the spot elements of normal or prestressed reinforced concrete, having each a radius of curvature equal to the bending radius of the cylindrical tank. It can easily be appreciated that while an element having a fixed radius of curvature generally gives rise to a cylindrical tank having the same bending radius, a plane element can give rise to polygonal tanks having a different number of sides according to the inclination between adjacent elements.

In other words, if tanks of different capacities are to be constructed it is necessary to vary either the height of said elements or, anyway, the radius of curvature, i.e., each element gives rise to a tank of determined capacity, and the provision of a tank having a different capacity requires the use of an element having other characteristics. To understand clearly the limits which practically are set to the use of such techniques it is sufficient to consider the enormous quantity of forms which are necessary for the provision of the various types of elements required for the manufacture of all the various types of containers demanded by the market.

SUMMARY OF THE INVENTION

The main object of the present invention is to prevent the aforementioned disadvantages by providing a plane plate made of reinforced concrete, which is generally prestressed, which plate, in association with other identical plates, permits the manufacture of substantially polygonal tanks of various capacities.

Another object of the invention is to render it possible to produce said plate on an industrial scale, whereby the plate will result economically advantageous.

A further, but not last object of the invention is to render safe and reliable the operation of the tank produced by assembling the aforementioned plates.

These objects, as well as other objects which will clearly appear from the following description, are attained by a liquidtight tank made of generally prestressed reinforced concrete, particularly for purification plants, comprising a plurality of plane plates which are connectable to each other and comprise substantially a central portion and a hammer-shaped element disposed at each of the two ends, characterized in that between two said hammer-shaped elements belonging to two consecutive plane plates which are approached to each other at the moment of the assembly, there is interposed a connection element so that said two consecutive plane plates are connected to each other forming an angle which depends on the dimensions and shape of said connection element, said plane plates containing, in their interior, sheath elements extending in the direction of the perimeter of said tank and capable of receiving, substantially, cables which, coming out from slots which open on abutments or saddles defining a substantially cylindrical surface (said abutments or saddles being formed on said hammer-shaped elements) and being put under tension and locked by means of anchorage clamps engaging on said abutments or saddles, provide both the assembly of said plane plates, thus forming a substantially polygonal tank, and the prestress of said concrete in the horizontal direction.

BRIEF DESCRIPTION OF THE DRAWINGS

Further characteristics and advantages of the present invention will result more apparently from the description of a preferred but not exclusive embodiment according to the invention, shown by way of non limiting example in the annexed drawings, in which.

DETAILED DESCRIPTION OF THE INVENTION

Figure 1:
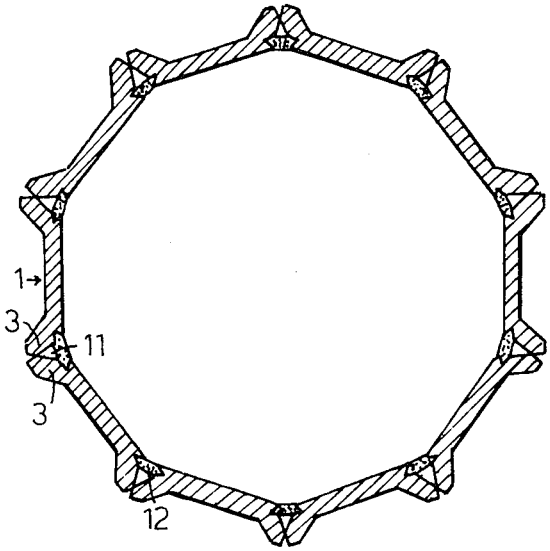
FIG. 1 is a top view of a polygonal tank having ten sides.
Figure 2:
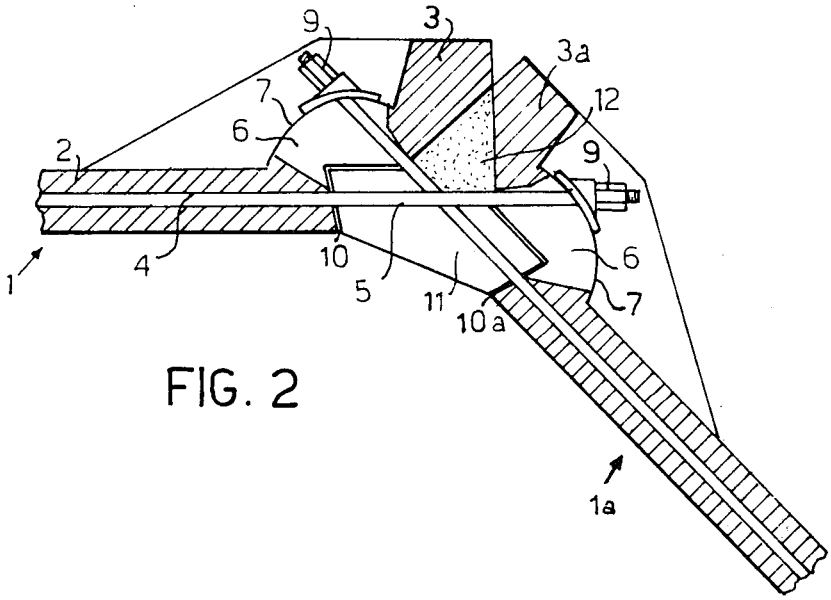
FIG. 2 shows a detail of the assembly of two adjacent plane plates.

Referring to the Figures described above, the plane plate 1 made of generally prestressed reinforced concrete, consists substantially of a central or plane surface portion 2 having a constant thickness and rectalinear ribs or hammer-shaped elements 3 formed on the end portions of the plate, which end portions, at the moment of the assembly, are approached to the end portions of the adjacent plane plates.

Positioned in the interior of said plane plate 1 are holes or sheath elements 4 suitably spaced along the height of the plate. Received in the interior of said sheaths are cables, strands or plaits 5 which, as will be pointed out more clearly later, provide for both the assembly of the adjacent plane plates, and the prestress of the concrete.

Disposed on the hammer-shaped elements 3, at the same level as the sheaths 4, are slots or perforations 6 which allow the passage of the strands or plaits 5. On the outer side of the plane plate 1, said slots open on a substantially cylindrical surface 7, which will conventionally be called saddle.

Said saddle 7 extends in the interior of a cavity or recess 8 formed on the hammer-shaped element 3.

Reference numeral 9 indicates anchorage clamps of the strands or plaits 5, which clamps abut against the saddle 7. Formed on the inner side of each hammer-shaped element 3 is a cavity 10 which extends along the whole height of the hammer-shaped element 3.

Said cavity 10 is partially occupied by a connection or filling element 11 made of reinforced concrete, thus forming an established angle between two adjacent plane plates.

If it is desired to have between two adjacent plane plates an angle different from the preceding one, it is sufficient to interpose a different connection element 11 in the cavities 10 and 10*a* formed in the interior of the hammer-shaped elements 3 and 3*a*, respectively, of the adjacent plane plates 1 and 1*a* respectively.

The above explanations of the structure will be sufficient for a person skilled in the art to realize the indubitable inventive advantages deriving from a construction of this type. Anyway, these advantages will be put more into evidence both by describing the particular process of production of said plates and by pointing out the methods of assembly of said plates.

The inventive effort for the realization of such plane plates has been directed to obtaining plane plates by a highly industrial process, such as to reduce to the minimum the cost of labor.

Moreover, the aim was to provide a type of plane plate which, by simply varying the connection element interposed between two adjacent plates, permits the production of tanks having the most disparate capacities.

In fact, it is beyond doubt that the provision of a single type of plane plate for the construction of tanks having a very different capacity from each other allows a mass-production and the storage of a single type of product, thereby rendering it possible to meet at the right time the most disparate requirements of the market.

The production of said plane plates is carried out on special paths. Along the length of each path there is disposed a form which is an exact negative copy of the plane plate. Moreover, the form is made of two different types of elements. The first type of element is formed simply by the surface of the plane plate. The second type is formed by suitable box-shaped elements which reproduce the saddles and the slots. Then, along the length of the path are interposed various diaphragms arranged at a distance equal to the height of the plane plate, and moreover said box-shaped elements are disposed at the points where it is desired to form the saddles and the slots for the passage of the strands or plaits 5 serving to obtain the prestress at the moment of the assembly of the plane plates. Furthermore, strands or wires may eventually be stretched from one end to the other of the path in order to effect the prestress, by adhesion, of the concrete in the vertical direction of the tank formed by the plane plates.

It is clear that the casting may be carried out either on forms positioned vertically and provided with vibrator elements in order to tamp the concrete, or on horizontal forms, and in this latter case the smoothing and finishing of the inner surface of the plane plates is carried out by means of outer vibratory finishing equipment.

The installation of the tank according to the invention is carried out in the following way. Knowing the desired capacity of the tank, the number of plane plates required in order to construct a tank meeting the required characteristics is determined. If the capacity of the tank is towards the lower limits of the range of variation of the capacity, a tank having a square base will certainly be chosen, that is to say, a tank made of plane plates forming between them an inner right angle.

For higher capacities, a tank will be chosen which has a pentagonal, hexagonal, heptagonal, octagonal, and so on, base, according to the desired capacity, i.e., a tank will be chosen which is formed, respectively, by five, six, seven, eight sides, and so on. It is clear that there is no theoretical upper limit for the number of sides, because, theoretically, for enormous capacities it would be possible to adopt a tank having a base plan formed by a regular polygon having a very large number of sides. For merely practical reasons, the number of possible polygonal plans for the tank will be limited, since for each polygonal plan that is available it will be necessary to use a different connection element 11, since the element 11 determines the inner dihedral angle formed by two adjacent plane plates, which angle depends on the number of sides of the polygon and is bound to it by the relation $(n - 2)/n\ (180°)$, where $n$ is the number of sides of the polygon. It is clear that it is possible to vary the capacity of the purification tank not only by varying the number of sides of the plan of the tank, but also by varying the height of the plane plate; however, while the number of sides of the plan is fixed at the time of the installation by choosing the suitable connection element 11, the height of the plane plate is fixed at the time of the manufacture of the plane plates, even if this is very simple because it is sufficient to merely move the diaphragms along the path in which the casting is carried out, so as to obtain the desired height for the plane plates.

After having established, for instance, that to obtain a certain capacity it is necessary to have a tank having a decagonal plan, as can be seen in FIG. 1, a connection element 11 is chosen whose dimensions are such as to form between two adjacent plates an angle of 144°, which is obtained by merely substituting $n=10$ in the relation $(n - 2)/n\ (180°)$.

The 10 plane plates 1 are successively disposed one near the other so as to form a regular decagon and an element of connection 11 is interposed between each two adjacent plane plates. Then, the strands 5 are passed into the sheaths 4 and after having been made to come out from the slots 6 they are subject to tension and then locked in accordance with the usual modern techniques, by means of the anchorage clamps 9 which bear on the respective saddles 7.

An additional casting is made into the cavity 12 in order to obtain a perfect seal of the tank.

A further casting is made also into the recesses 8 which receive the saddles 7 and anchorage clamps 9.

Figure 3:
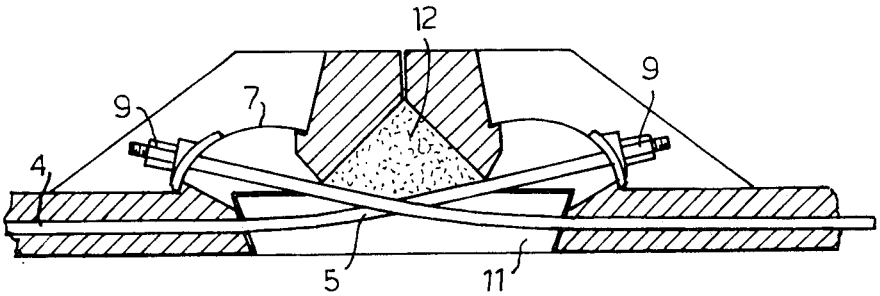
FIG. 3 shows a detail of the assembly of two adjacent plane plates under another angle.
Figure 4:
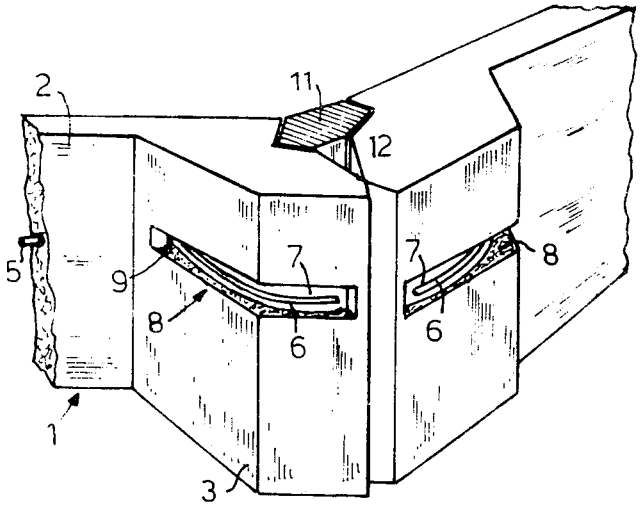
FIG. 4 is a perspective view of the detail shown in FIG. 2.

The tension of the strands 5 has the double purpose of connecting the plane plates 1 to each other and providing the prestress of the concrete in the horizontal direction. Owing to the configuration of the element, there are minimal friction losses during the establishment of tension in the strands 5. The concrete can eventually be prestressed also in the vertical direction by means of adherent plaits or strands. From the foregoing it appears clearly that it would be possible to provide, with the same easiness, a tank having a certain number of different sides by merely choosing a connection element 11 forming the desired angle between two adjacent plane plates; the anchorage clamps 9 would automatically be disposed in a different position on the saddles 7, so as to produce the desired tension. In practice, as is clearly shown in the annexed drawings, the inner angle between two adjacent plane plates has a range of variation from 90° to 180°. By choosing an angle of 90°, a tank is obtained which has a square plan formed by four plane plates. With angles comprised between 90° and 180° a polygonal tank with more than four sides is obtained. Finally, as clearly shown in FIG. 3, the plane plates may be connected to each other also by forming an angle of 180°. This solution is particularly useful in case it is desired to increase the length of the side of the polygon (and, consequently, the capacity of the tank) without excessively increasing the number of sides; in this case, two different types of connection elements will have to be used.

Figure 5:
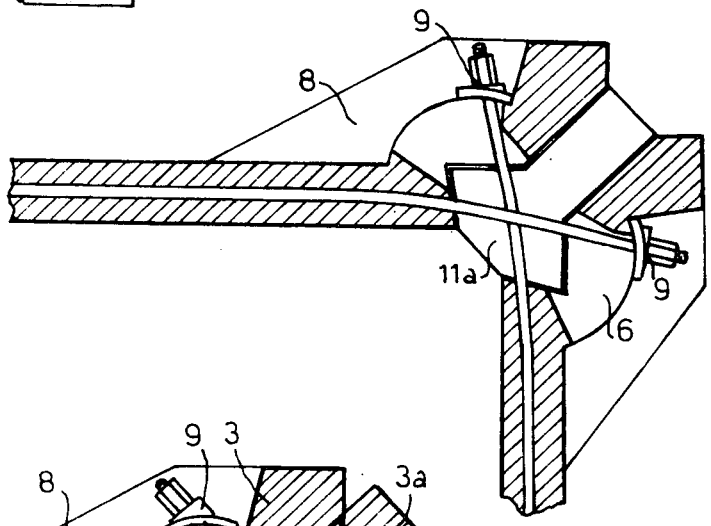
FIG. 5 shows a detail of the assembly of two adjacent plane plates under a right angle.

In case the plane plates are connected to each other forming an angle of 90°, as shown in FIG. 5, the connection element assumes the particular shape of the element 11*a* shown in FIG. 5. Alternatively, instead of the connection element 11*a* shown in FIG. 5, a stripe of insulating material can be used, by carrying out a casting of concrete into the cavities 10.

Obviously, the invention thus conceived is susceptible of numerous modifications and variations, all of which are comprised within the scope of the inventive idea.

Figure 6:
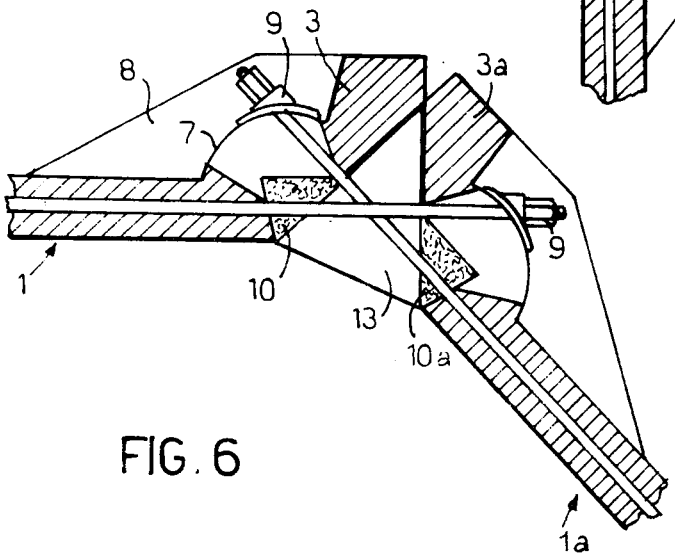
FIG. 6 shows a detail of the assembly of two adjacent plane plates according to a second possible embodiment.

Thus, instead of connection element 11 a wedge-shaped element 13 may be provided, also made of concrete, as appears clearly from FIG. 6; by merely varying the angle of the wedge, a variation of the angle between two adjacent plates, and, consequently, of the number of sides of the polygon forming the plan of the tank, is obtained.

When choosing this latter embodiment it will be necessary to effect an additional casting into the side cavities 10. It is clear that in case of dangerous concentrations of stresses it will be possible to displace the position of the cavities 10, without departing from the scope of the inventive concept.

Figure 7:
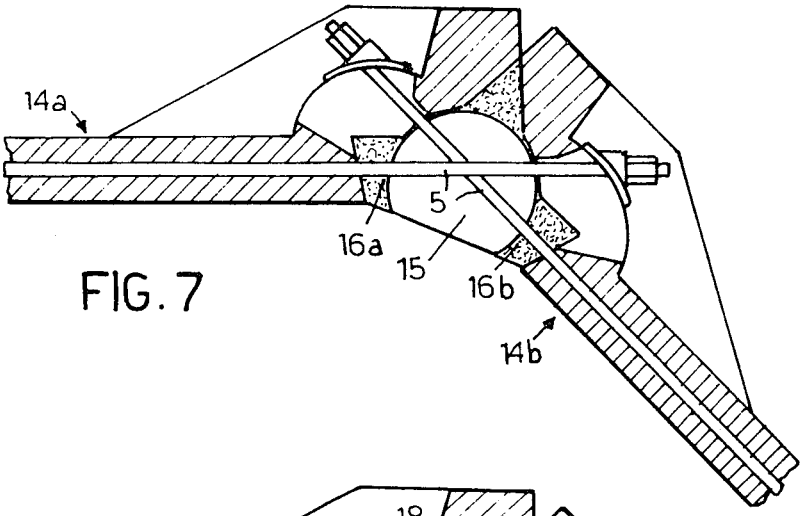
FIG. 7 shows a detail of the assembly of two adjacent plane plates according to a third possible embodiment.
Figure 8:
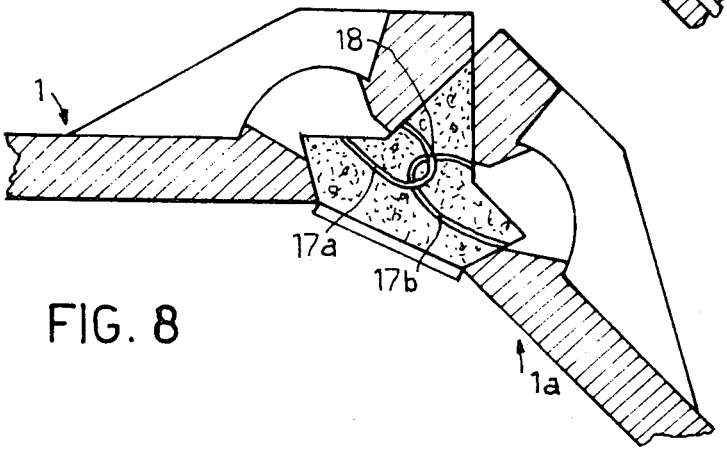
Figure 9:
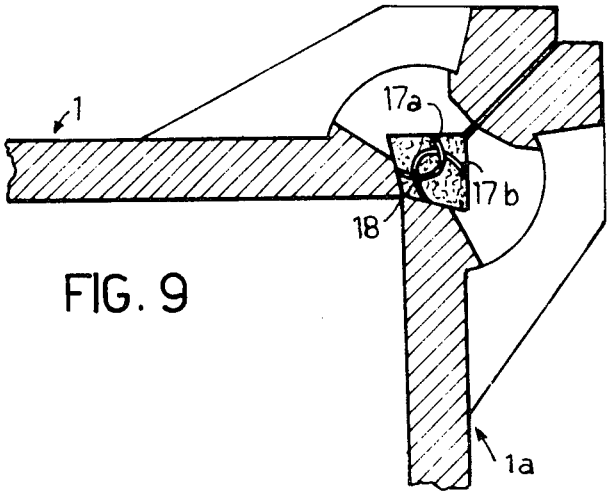

According to a further embodiment of the invention, as shown in FIG. 7, the assembly of the elements or plane plates 14*a* and 14*b* is carried out by interposing between them, as connection element, a cylindrical latch 15 made of concrete.

The inner surfaces of the hammer-shaped elements are cylindrical in shape, so as to receive partially the cylindrical latch 15. An additional casting of concrete is then carried out into the side cavities 16*a* and 16*b.* What readily appears as being very interesting is the fact that, according to this embodiment on changing the angle between two adjacent elements 14*a* and 14*b* the connection element remains unchanged. The cylindrical latch 15, i.e., the connection element, may be truncate according to the angle between two connection elements. However, this is carried out always by means of the same form by interposing suitable diaphragms, thus obtaining a production with remarkable characteristics of industrialization.

Of course, it is obvious that the connection element 11, as well as the element 11*a* and as well as the element 13 and the element 15, may be provided indifferently with holes or slots, not shown in the annexed drawings, in order to allow the positioning of the strands 5 which have to be stretched.

Finally, it is realized that it is not indispensable to pre-fabricate the connection elements 11 and 13, inasmuch as it is possible to eventually effect a casting directly on the spot, after the strands 5 have been passed through. The stretching of the strands will then be carried out after the casting has hardened.

The invention thus conceived attains the objects it aims at. In fact, by producing on a highly industrial scale a single type of plane plate of reinforced concrete which it is absolutely not necessary to prestress, it is possible to produce tanks of practically any capacity and dimensions.

All the details which have been discussed are replaceable by other technically equivalent elements; the dimensions and materials used, although the best results have been obtained by using concrete and steel, may be replaced by any other dimensions and materials according to the requirements.

What we claim is:

1. A liquidtight tank or reservoir comprising:

a. a plurality of plate elements disposed adjacent to each other according to a pre-established configuration, each of which plate elements is delimited by two rectilinear edges and a pair of plane surfaces and comprises two rectilinear ribs extending along the two rectilinear edges respectively and projecting sideways from one of said plane surfaces; each of said plate elements being provided with holes which are substantially orthogonal to the length of said ribs; each of said rectilinear ribs being provided with a plurality of perforations each of which extends completely through the rib, the dimension of each of said perforations, as measured in a direction orthogonal to the length of said rib, being greater than the dimension of the perforation as measured in a direction along the rib; and each of said ribs being provided at each of said perforations, with a cavity having at its bottom a cylindrical support seating;

b. cables arranged to be put under tension, each of which extends through one of said holes of one plate element and through corresponding perforations of ribs of two plate elements adjacent to said one plate element, the ends of said cable projecting from said perforations into the corresponding cavities;

c. anchorage clamps, each of which locks the ends of one of said cables, and rests on a corresponding one of said seatings and is housed in a corresponding one of said cavities; and d. filling elements, each of which is disposed between two adjacent ribs belonging to two adjacent plate elements and between the corresponding edges of said elements.

2. A tank or reservoir as claimed in claim 1, wherein each of said filling elements is formed by casting a building material into the cavity which is present between two adjacent ribs belonging to two adjacent plate elements and between the corresponding edges of these elements.

3. A tank or reservoir as claimed in claim 1, wherein each of said filling elements is constituted by a prefabricated element made of a building material and has a configuration substantially equal to that of the cavity which is present between two of said adjacent ribs belonging to two adjacent plate elements and between the corresponding edges of these elements.

4. A tank or reservoir as claimed in claim 1, wherein each of said filling elements is constituted by a prefabricated element of building material and by one or more castings of building material into the cavities which are present between said prefabricated element and two adjacent ribs belonging to two adjacent plate elements.

* * * * *